US009276364B2

(12) United States Patent
Mitsuno et al.

(10) Patent No.: US 9,276,364 B2
(45) Date of Patent: Mar. 1, 2016

(54) TERMINAL INCLUDING CUT-OUT OR OPENING AT PORTION OF OVERLAP WITH ANOTHER TERMINAL

(71) Applicant: DAI-ICHI SEIKO CO., LTD., Kyoto (JP)

(72) Inventors: Kosuke Mitsuno, Tokyo (JP); Hiroaki Kuribayashi, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/529,598

(22) Filed: Oct. 31, 2014

(65) Prior Publication Data

US 2015/0132997 A1 May 14, 2015

(30) Foreign Application Priority Data

Nov. 11, 2013 (JP) ..... 2013-233291

(51) Int. Cl.

| | |
|---|---|
| ***H01R 9/05*** | (2006.01) |
| ***H01R 24/50*** | (2011.01) |
| ***H01R 33/20*** | (2006.01) |
| *H01R 103/00* | (2006.01) |

(52) U.S. Cl.

CPC ..... *H01R 24/50* (2013.01); *H01R 33/205* (2013.01); *H01R 2103/00* (2013.01)

(58) Field of Classification Search

CPC ..... H01R 33/20; H01R 33/205; H01R 24/00; H01R 24/38; H01R 24/40; H01R 24/52; H01R 24/58

USPC ..... 439/675, 578–585

See application file for complete search history.

(56) References Cited

U.S. PATENT DOCUMENTS

| | | | | |
|---|---|---|---|---|
| 5,772,470 | A * | 6/1998 | Togashi | H01R 9/0518 439/582 |
| 6,474,995 | B1 * | 11/2002 | Wu | H01R 24/50 439/63 |
| 6,932,615 | B1 * | 8/2005 | Yeo | H01R 24/46 439/63 |
| 7,367,811 | B2 * | 5/2008 | Nagata | H01R 24/50 439/63 |
| 8,262,398 | B2 * | 9/2012 | Chen | H01R 24/50 439/188 |
| 8,414,306 | B2 * | 4/2013 | Tagawa | H01R 24/50 439/63 |
| 8,657,608 | B2 * | 2/2014 | Tsai | H01R 24/50 439/581 |
| 8,721,347 | B2 * | 5/2014 | Xiao | H01R 24/50 439/63 |
| 2005/0159022 | A1 | 7/2005 | Nagata | |

(Continued)

FOREIGN PATENT DOCUMENTS

| | | |
|---|---|---|
| CN | 202759104 | 2/2013 |
| JP | 7-24791 | 6/1995 |

(Continued)

*Primary Examiner* — Chandrika Prasad

(74) *Attorney, Agent, or Firm* — Wenderoth, Lind & Ponack, L.L.P.

(57) ABSTRACT

The receptacle connector includes a central terminal mechanically and electrically connecting with a core wire of a coaxial cable connected to a plug connector, and an outer terminal mechanically and electrically connecting with an external conductor surrounding the core wire with an internal electrical-insulator being sandwiched therebetween, the central terminal including a first contact making contact with the core wire, and a second contact electrically connected to the first contact, passing through under the outer terminal and extending to the outside of the outer terminal, the second contact being formed with at least one of a cut-out and an opening in an area where the second contact overlaps the outer terminal.

8 Claims, 13 Drawing Sheets

(56) References Cited

U.S. PATENT DOCUMENTS

| | | | | |
|---|---|---|---|---|
| 2008/0034583 | A1* | 2/2008 | Chen | H01R 43/24 29/876 |
| 2010/0248503 | A1 | 9/2010 | Kang et al. | |
| 2014/0024258 | A1 | 1/2014 | Tsai et al. | |

FOREIGN PATENT DOCUMENTS

| | | |
|---|---|---|
| JP | 2005-209364 | 8/2005 |
| JP | 2010-272244 | 12/2010 |
| JP | 2011-503783 | 1/2011 |

* cited by examiner

FIG. 13A - PRIOR ART
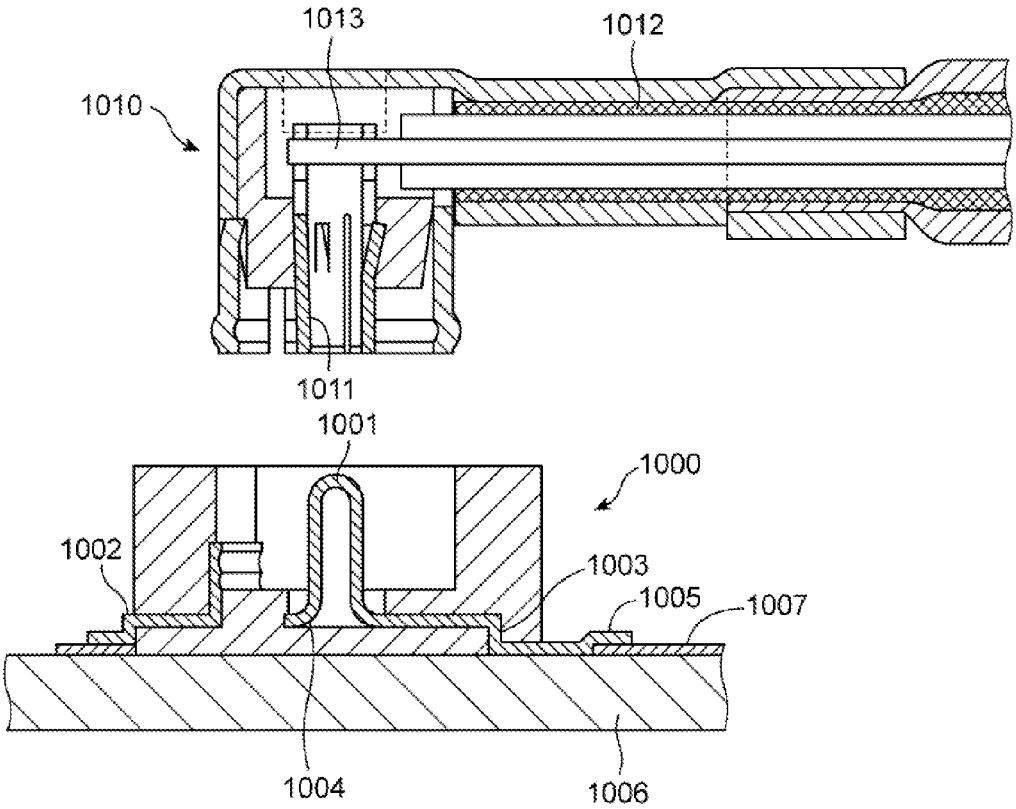
FIG. 13B - PRIOR ART
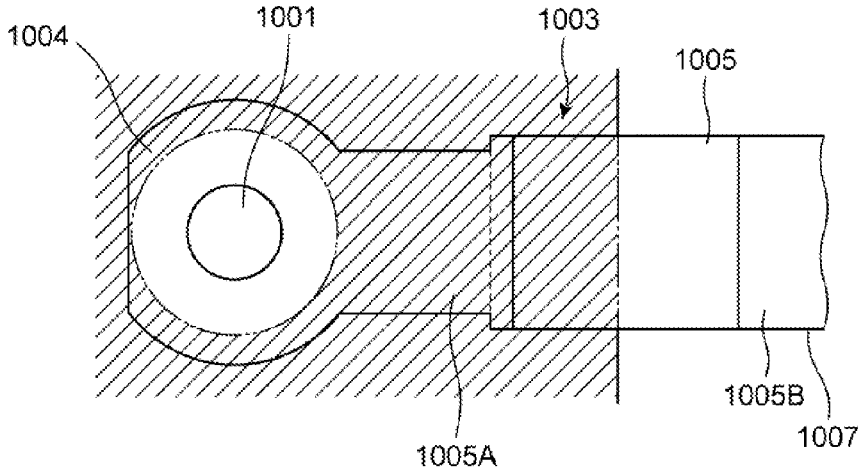

FIG. 14 - PRIOR ART
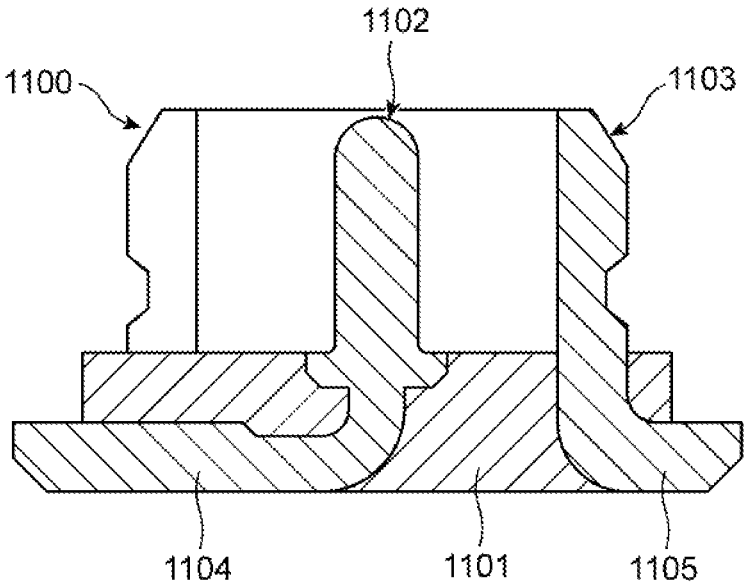

TERMINAL INCLUDING CUT-OUT OR OPENING AT PORTION OF OVERLAP WITH ANOTHER TERMINAL

BACKGROUND OF THE INVENTION

1. Field of the Invention

The invention relates to a receptacle connector including a central terminal mechanically and electrically connecting with a core wire of a coaxial cable connected to a plug connector, and an outer terminal mechanically and electrically connecting with an external conductor surrounding the core wire with an internal electrical-insulator being sandwiched therebetween.

The invention relates further to a terminal used for the receptacle connector.

2. Description of the Related Art

As one of connectors used for connecting a coaxial cable to a printed circuit board, there is known a receptacle connector into which a plug connector connected to a coaxial cable is fit. A receptacle connector is used for transmission of video-camera signals, and transmission of signals for connecting an antenna used for radio-signal communication such as to a printed circuit board, for instance. A coaxial cable having a diameter of about 0.5 mm is connected to a receptacle connector. Various receptacle connectors have been suggested as follows.

FIGS. 13A and 13B illustrate a receptacle connector suggested in Japanese Utility Model Publication No. H7 (1995)-24791.

The illustrated receptacle connector 1000 includes a central terminal 1001, and an external terminal 1002 located around the central terminal 1001 in electrically insulating condition with the central terminal 1001.

The central terminal 1001 stands at a distal end 1004 of a plate-shaped connector 1003. The external terminal 1002 not entirely, but partially surrounds the central terminal 1001. The connector 1003 includes a strip 1005 having a first portion 1005A located closer to the distal end 1004, and a second portion 1005B located away from the distal end 1004. The first portion 1005A is smaller in width than the second portion 1005B. The strip 1005 is connected at the second portion B to a strip line 1007 formed on a surface of a circuit board 1006. As illustrated in FIG. 13A, the strip 1005 is bent at a boundary between the first and second portions 1005A and 1005B such that the first portion 1005A is set higher than the second portion 1005B, and further, as illustrated in FIG. 13B, the first portion 1005A is smaller in width than the second portion 1005B. This is because a height from a lower surface of the circuit board 1006 to the first portion 1005A and a height from a lower surface of the circuit board 1006 to the second portion 1005B are different from each other, and accordingly, an effective dielectric constant below the first portion 1005A and an effective dielectric constant below the second portion 1005B are different from each other. Even if an effective dielectric constant varies in dependence on an area of the strip 1005, an impedance characteristic can be adjusted between the first and second portions 1005A and 1005B by partially varying a width of the strip 1005. As shown in FIG. 13A, a plug connector 1010 has a plug conductor 1011 which makes contact with the central terminal 1001 of the receptacle connector 1000 and a coaxial cable 1012 whose core conductor 1013 is connected to the plug conductor.

FIG. 14 illustrates a receptacle connector suggested in Japanese Patent Application Publication No. 2010-272244.

The illustrated receptacle connector 1100 includes a housing 1101 made from an electrically insulating plate and having a substantially rectangular cross-section, a central terminal 1102, and an external terminal 1103. The central terminal 1102 and the external terminal 1103 are fixed to the housing 1101 by insert molding such that they are coaxial with each other. The central terminal 1102 is solid, and the external terminal 1103 is in the form of a cylinder such that the central terminal 1102 is located at a center of the external terminal 1103. Contact supports 1104 and 1105 extend almost horizontally in the housing 1101 along a lower surface of the housing 1101. The contact supports 1104 and 1105 have lower surfaces extending on a level with a lower surface of the housing 1101, and exposed downwardly.

In the receptacle connector 1000 illustrated in FIGS. 12A and 13B, the external terminal 1002 is designed to partially surround the central terminal 1001 therewith. In the receptacle connector 1100 illustrated in FIG. 14, the external terminal 1103 is designed to be cylindrical. For instance, the external terminal in the receptacle connector 1000 illustrated in FIGS. 13A and 13B were designed to be annular, the connector 1003 has to be designed to extend below the external terminal 1002.

If the connector 1003 extends below the external terminal 1002, even if an impedance were adjusted between the first and second portions 1005A and 1005B, a capacitance to be generated between the external terminal 1002 and the central terminal 1001 would exert harmful influence on the impedance adjustment.

An electric connector used for connecting a coaxial cable with a printed circuit board is recently required to be smaller and smaller in size, and hence, a distance between the external terminal 1002 and the central terminal 1001 is smaller and smaller. Thus, the impedance adjustment becomes more and more difficult.

SUMMARY OF THE INVENTION

In view of the above-mentioned problem in the conventional electric connectors, it is an object of the present invention to provide a receptacle connector capable of readily carrying out the above-mentioned impedance adjustment, and further, of being down-sized.

It is further an object of the present invention to provide a terminal used for the above-mentioned receptacle connector.

In one aspect of the present invention, there is provided a receptacle connector including a central terminal mechanically and electrically connecting with a core wire of a coaxial cable connected to a plug connector, and an outer terminal mechanically and electrically connecting with an external conductor surrounding the core wire with an internal electrical-insulator being sandwiched therebetween, the central terminal including a first contact making contact with the core wire, and a second contact electrically connected to the first contact, passing through under the outer terminal and extending to the outside of the outer terminal, the second contact being formed with at least one of a cut-out and an opening in an area where the second contact overlaps the outer terminal.

In the receptacle connector in accordance with the present invention, a cut-out and/or an opening is(are) formed in an area where the second contact overlaps the outer terminal. Thus, an area in which the outer terminal and the second contact face each other can be reduced, ensuring that a capacitance defined by an area in which the outer terminal and the second contact face each other can be reduced.

It is preferable that the second contact is formed at one of side edges or both of side edges thereof with the cut-out.

Even if the second contact had a small width, a cut-out can e formed at a side edge or side edges.

It is preferable that the area is thinner than other areas.

By designing the area to be thinner than other areas, a distance between the outer terminal and the second contact can be increased, even if the outer terminal and the second contact had to be located close to each other because of the necessity of designing the receptacle connector to be low in height.

For instance, the second contact may be formed on at least one of upper and lower surfaces thereof in the area with a recess.

It is preferable that the outer terminal is formed with a recess in an area facing the second contact.

A distance between the outer terminal and the second contact can be increased, even if the outer terminal and the second contact had to be located close to each other because of the necessity of designing the receptacle connector to be low in height.

It is preferable that the outer terminal is ring-shaped coaxially with the central terminal.

By designing the outer terminal to be ling-shaped, the outer terminal can have an increased area with which the outer terminal makes contact with a TO plug connector. Furthermore, since the central terminal and the outer terminal are located coaxial with each other, electric relation between the central terminal and the outer terminal can be enhanced, and reliability to electrical connection between the receptacle connector and a plug connector can be enhanced. Since the second contact is designed to be formed with a cut-out and/or an opening in an area in which the second contact overlaps the outer terminal, even if the second contact extends in any direction, a capacitance defined by an area in which the second contact and the outer terminal overlap each other can be reduced.

In another aspect of the present invention, there is provided a terminal electrically connecting with a coaxial cable including a core wire, and an external conductor surrounding the core wire with an internal electrical-insulator being sandwiched therebetween, the terminal being mechanically and electrically connected to the core wire, and being used together with a second terminal mechanically and electrically connected to the external conductor, the terminal including a first contact making contact with the core wire, and a second contact being in the form of a plate, the second contact having a length sufficient to pass through under said second terminal and extend to the outside of the second terminal when the terminal is used together with the second terminal, the second contact being formed with at least one of a cut-out and an opening in an area where the second contact overlaps the second terminal.

The advantages obtained by the aforementioned present invention will be described hereinbelow.

A capacitance defined by an area in which the second contact and the outer terminal overlap each other can be reduced by means of the cut-out and/or the opening formed at the second contact. Accordingly the impedance adjustment can be readily accomplished, and further, the receptacle connector can be readily down-sized.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIG. 13A is a cross-sectional view of the conventional receptacle and plug connectors.

FIG. 13B is a partial plan view of the receptacle connector illustrated in FIG. 13A.

FIG. 14 is a perspective view of the conventional receptacle connector.

DESCRIPTION OF THE PREFERRED EMBODIMENTS

Figure 1:
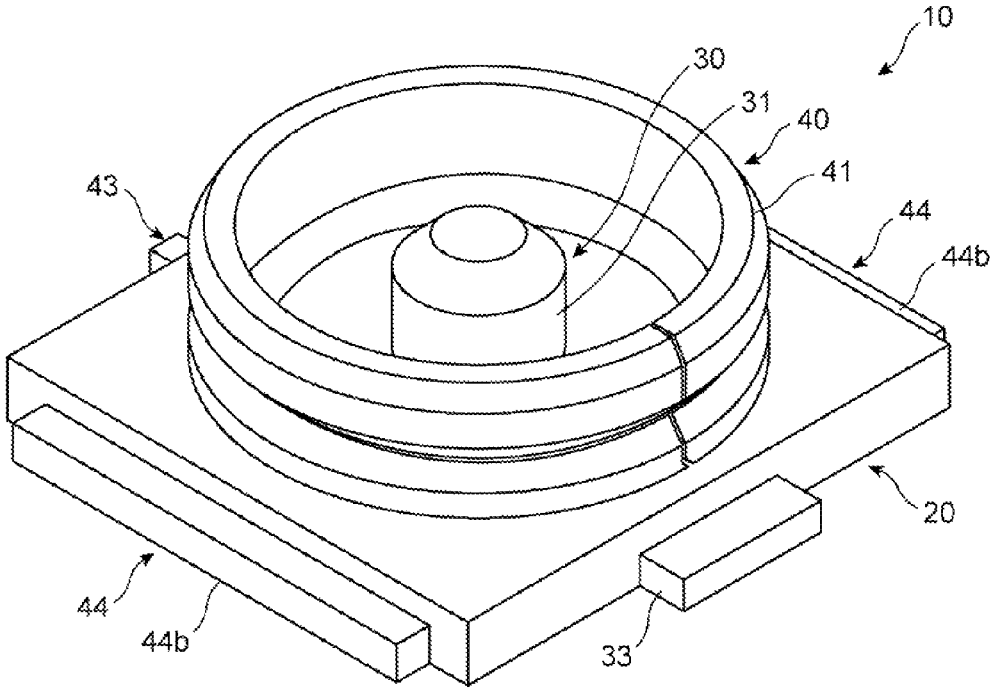
FIG. 1 is a perspective view of the receptacle connector in accordance with the first embodiment of the present invention.
Figure 2:
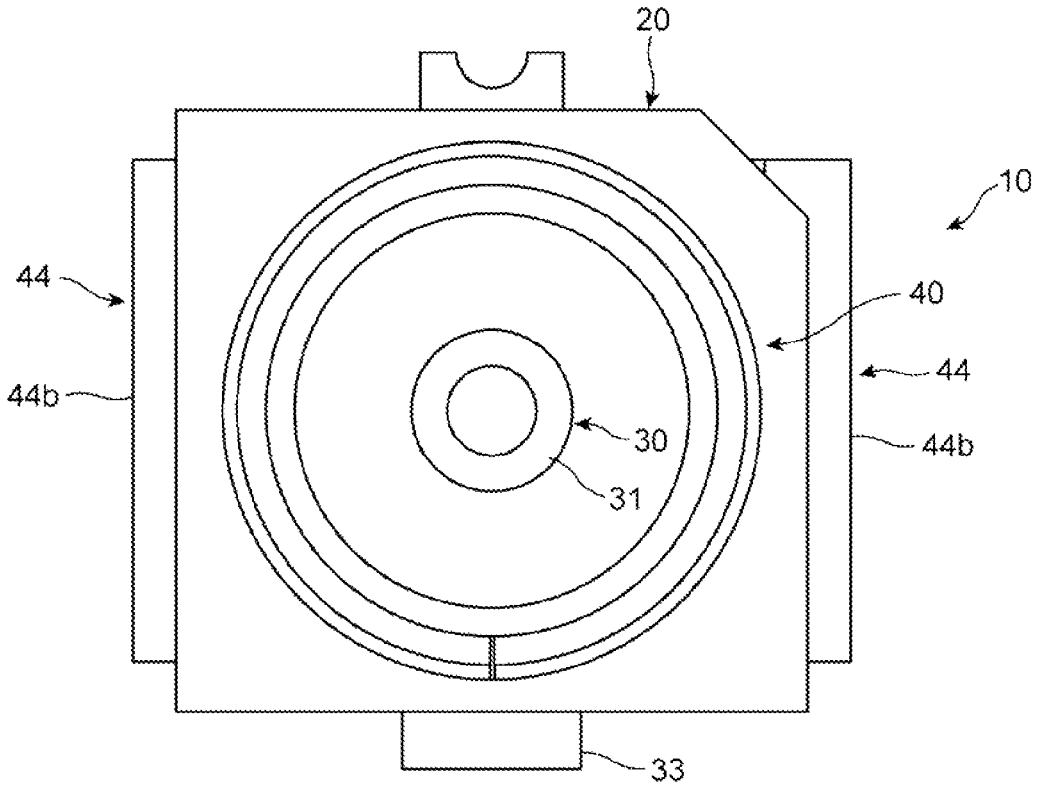
FIG. 2 is a plan view of the receptacle connector illustrated in FIG. 1.
Figure 3:
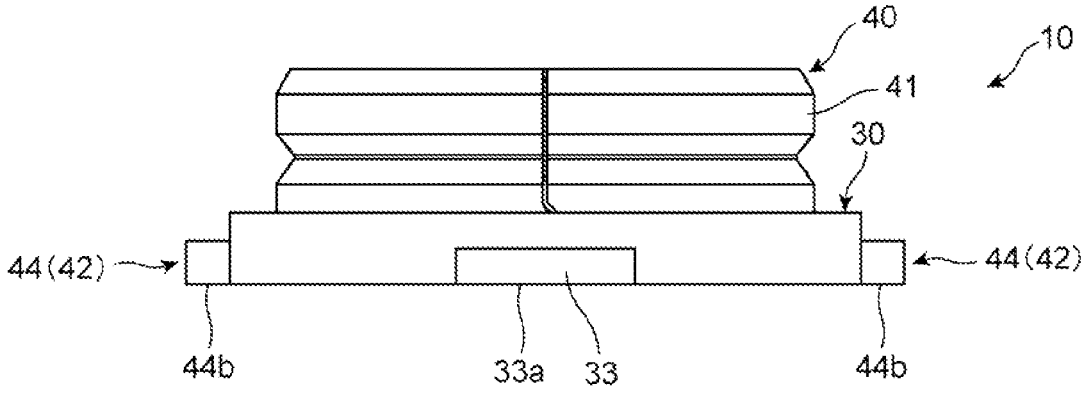
FIG. 3 is a front view of the receptacle connector illustrated in FIG. 1.
Figure 4:
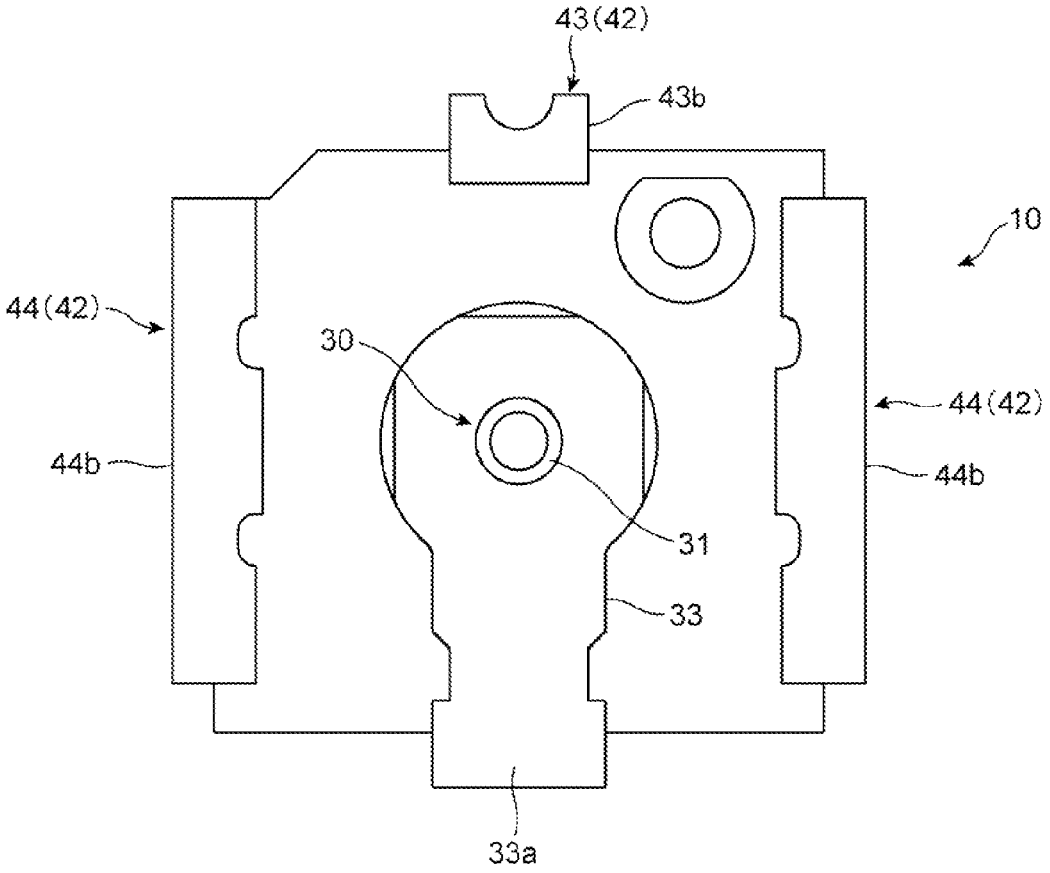
FIG. 4 is a bottom view of the receptacle connector illustrated in FIG. 1.

Preferred embodiments in accordance with the present invention will be explained hereinbelow with reference to drawings.

First Embodiment

FIGS. 1 to 4 illustrate a receptacle connector 10 accordance with the first embodiment of the present invention. The receptacle connector 10 is fit with a plug connector (not illustrated) connected to a coaxial cable to thereby electrically connect with the plug connector. The receptacle connector 10 is mounted on a surface of a circuit board, for instance.

The receptacle connector 10 includes a housing 20, a central terminal 30, and an outer terminal 40.

The housing 20 is rectangular when viewed vertically. The central terminal 30 and the outer terminal 40 are fixed on the housing 20 by insert molding such that the outer terminal 40 is located around a center of a later-mentioned first contact of the central terminal 30.

As illustrated in FIGS. 5 to 8, the central terminal 30 includes a first contact 31 making mechanical and electrical contact with a plug connector, a flange 32 extensive around the first contact 31, and a second contact 33 electrically connecting with the first contact 31, and extending below and beyond the outer terminal 40.

Figure 5:
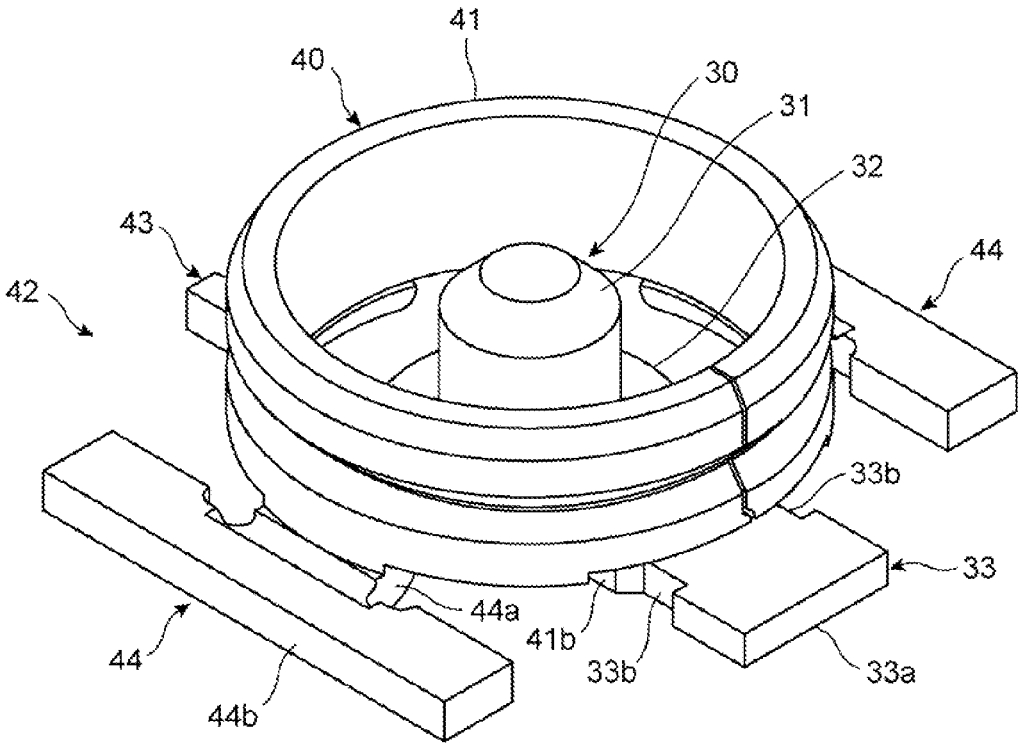
FIG. 5 is a perspective view of the central terminal and the outer terminal each defining a part of the receptacle connector in accordance with the first embodiment of the present invention.

As illustrated in FIG. 5, the first contact 31 upwardly projects from the flange 32. The first contact 31 is in the form of a bar, and has a hemisphere top. The flange 32 is comprised of a circular thin plate, and extends at a bottom of and radially of the first contact 31. The second contact 33 is in the form of a thin plate. The second contact 33 is mechanically and electrically connected at an end thereof with the first contact 31 through the flange 32. The second contact 33 defines at a distal end thereof a contact 33*a* which is to be connected to a metal pad formed on a printed circuit board (not illustrated) on which the receptacle connector 10 is mounted. Accordingly, the second contact 33 is exposed at a lower surface thereof out of the housing 20. Similarly, the first contact 31 and the flange 32 are exposed at lower surfaces thereof out of the housing 20. When the receptacle connector 10 and the plug connector are fit into each other, the first contact 31 makes contact at an outer surface thereof with an inner surface of a pair of coil spring terminals or cylindrical terminals which makes mechanical and electrical contact with a core conductor exposed outside by peeling off an external insulative cover, an external electrical conductor, and an internal insulator of a coaxial cable in the plug connector.

Figure 6:
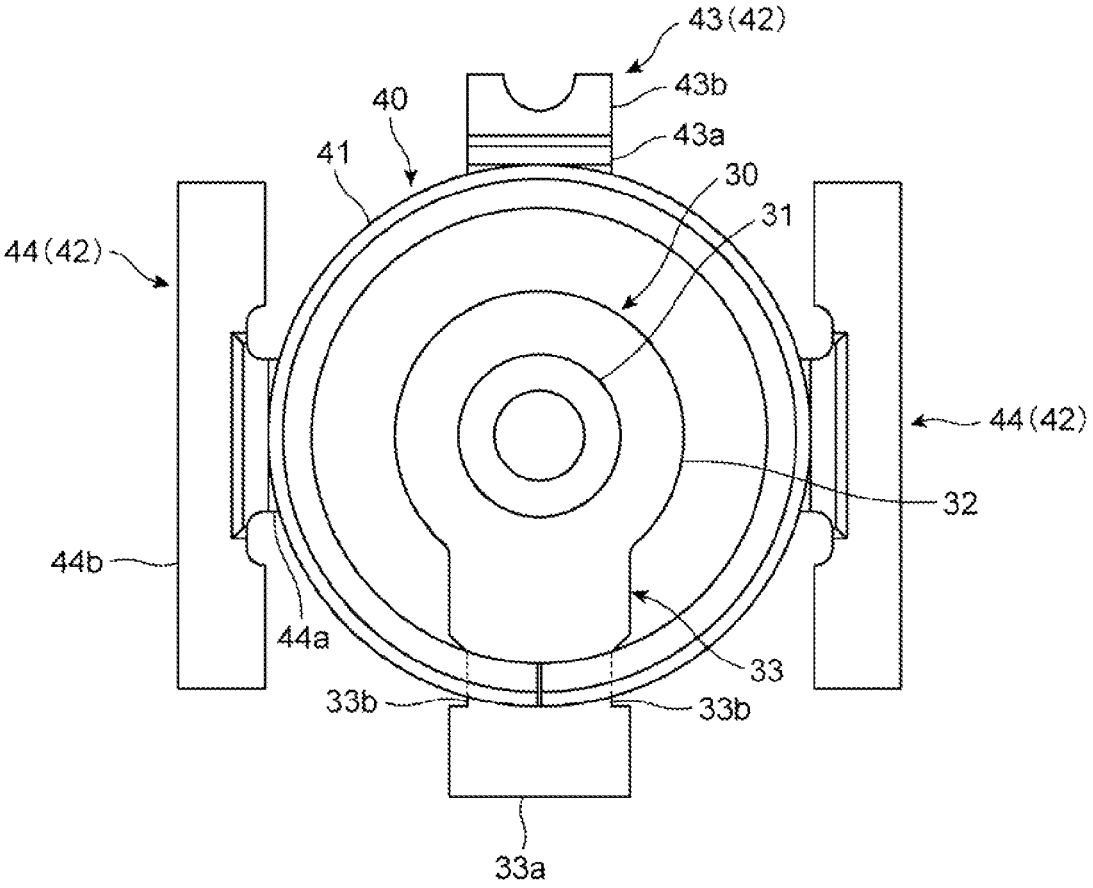
FIG. 6 is a plan view of the central terminal and the outer terminal illustrated in FIG. 5.
Figure 8:
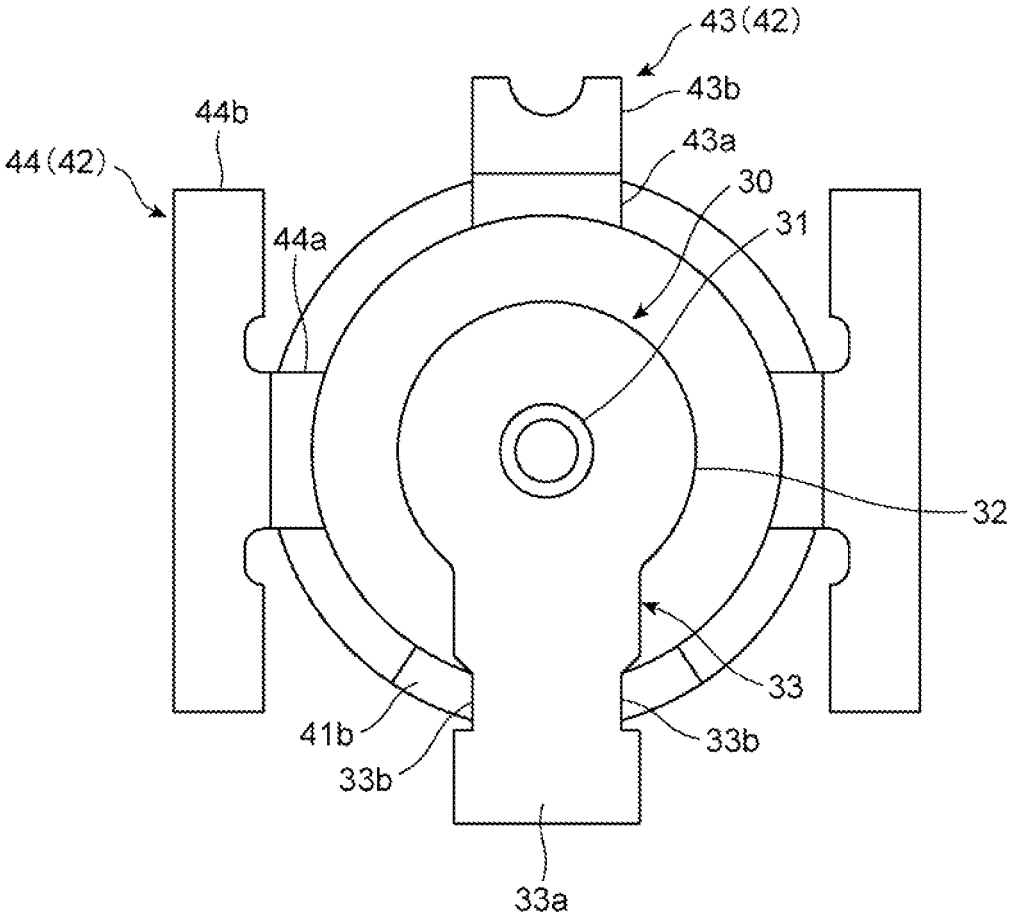
FIG. 8 is a bottom view of the central terminal and the outer terminal illustrated in FIG. 5.
Figure 9:
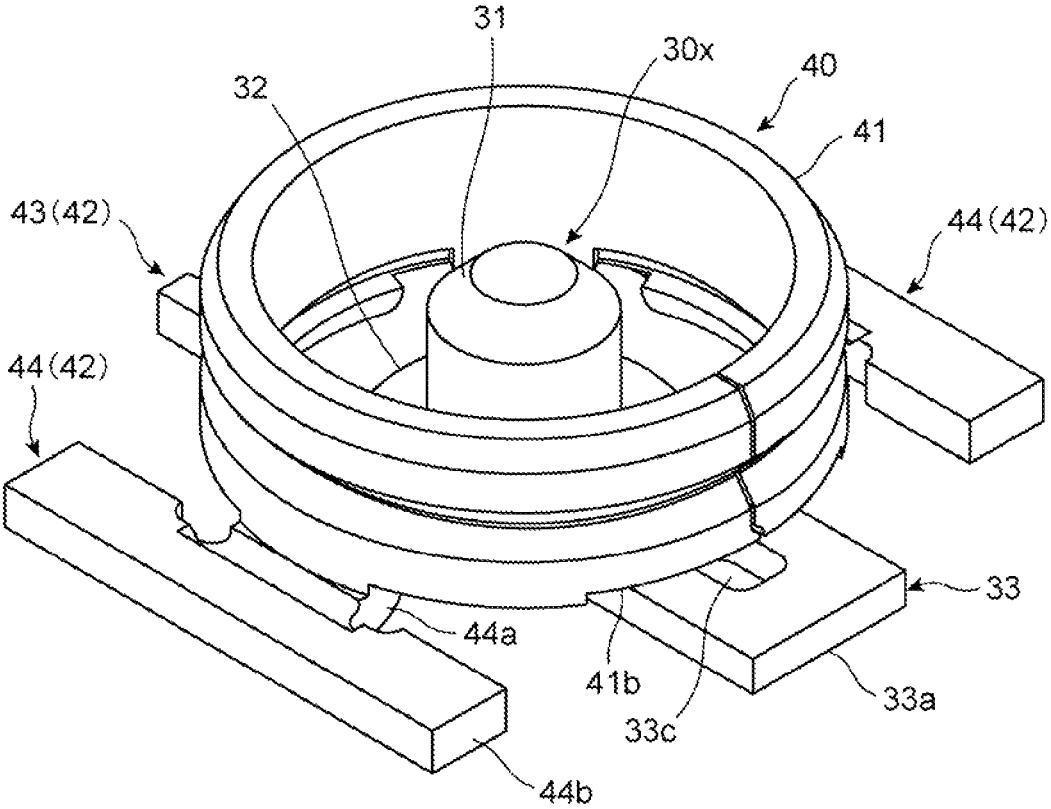
FIG. 9 is a perspective view of the central terminal and the outer terminal each defining a part of the receptacle connector in accordance with the second embodiment of the present invention.
Figure 10A:
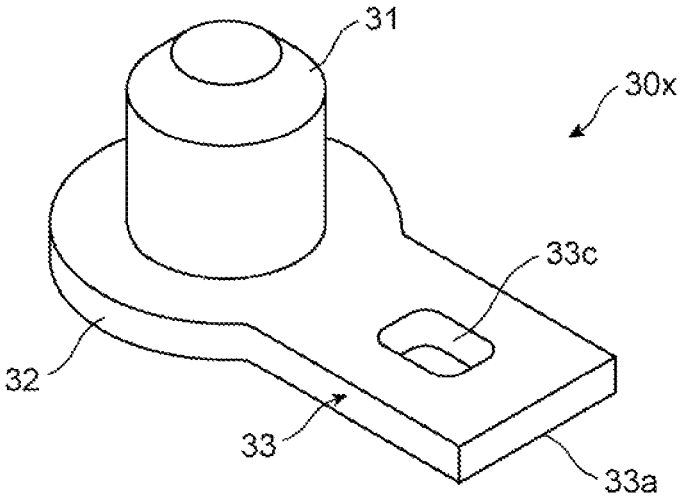
FIG. 10A is a perspective view of the central terminal illustrated in FIG. 9.
Figure 10B:
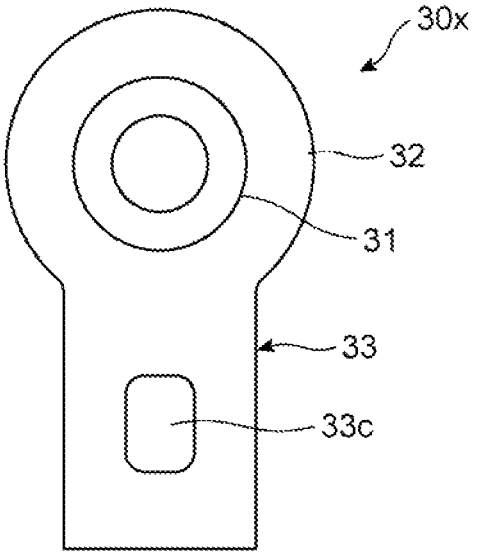
FIG. 10B is a plan view of the central terminal illustrated in FIG. 10A.
Figure 10C:
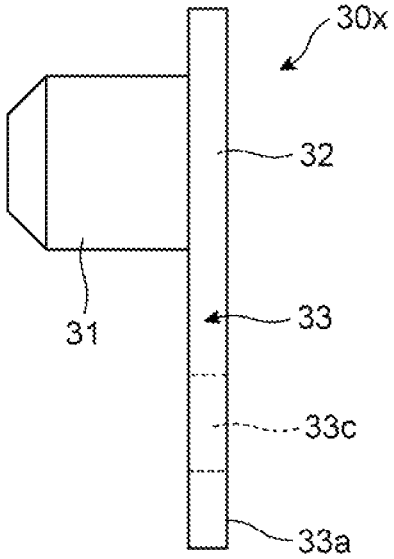
FIG. 10C is a right side view of the central terminal illustrated in FIG. 10A.
Figure 10D:
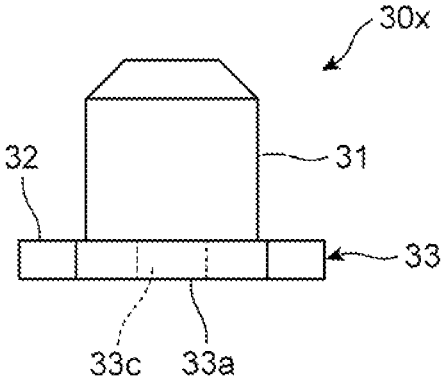
FIG. 10D is a front view of the central terminal illustrated in FIG. 10A.
Figure 11:
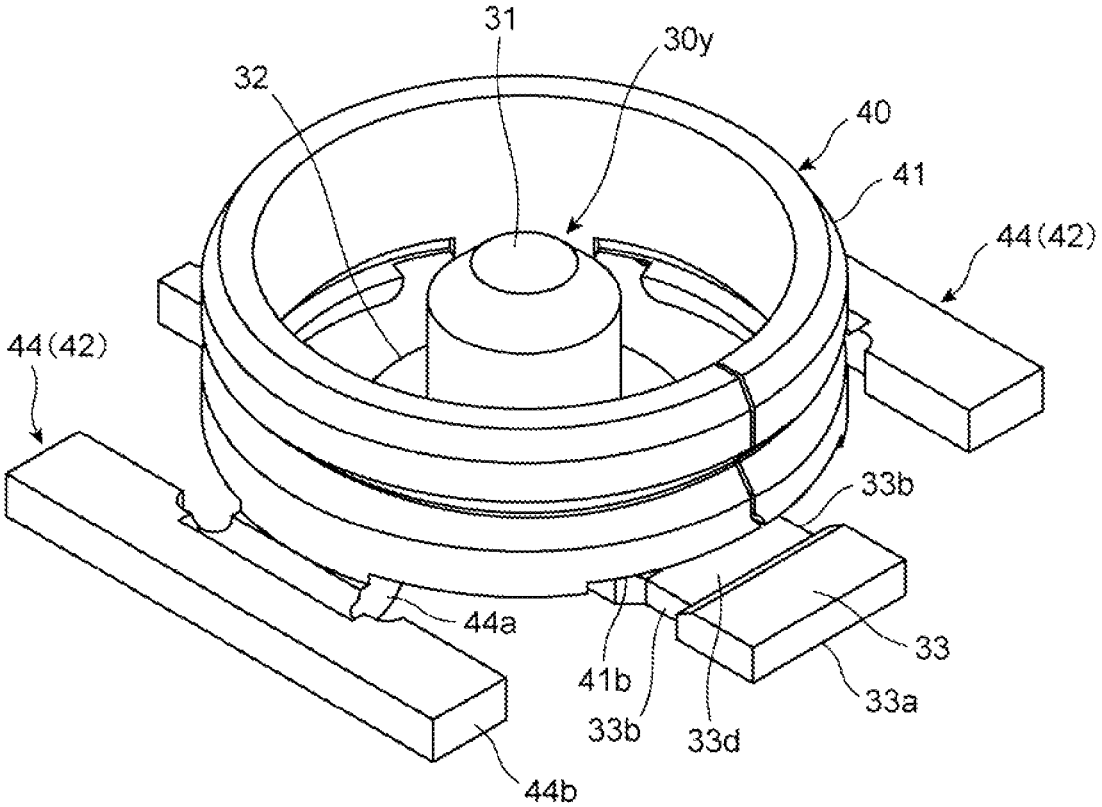
FIG. 11 is a perspective view of the central terminal and the outer terminal each defining a part of the receptacle connector in accordance with the third embodiment of the present invention.
Figure 12A:
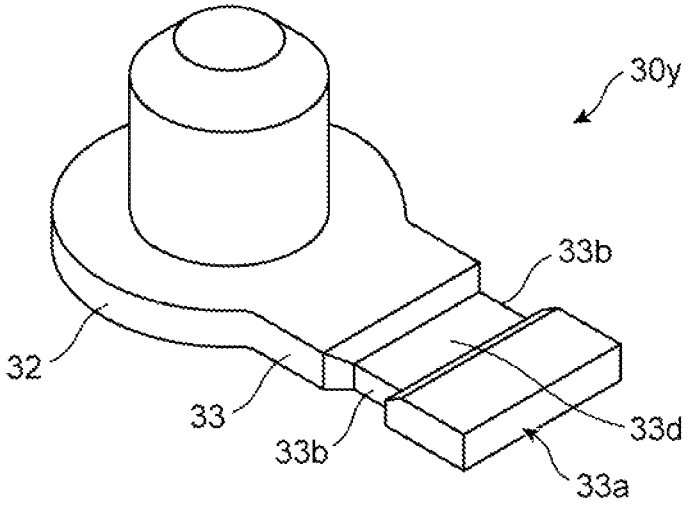
FIG. 12A is a perspective view of the central terminal illustrated in FIG. 11.
Figure 12B:
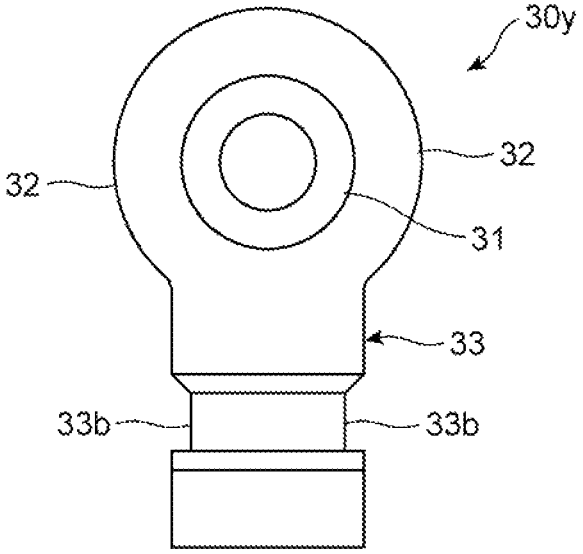
FIG. 12B is a plan view of the central terminal illustrated in FIG. 12A.
Figure 12C:
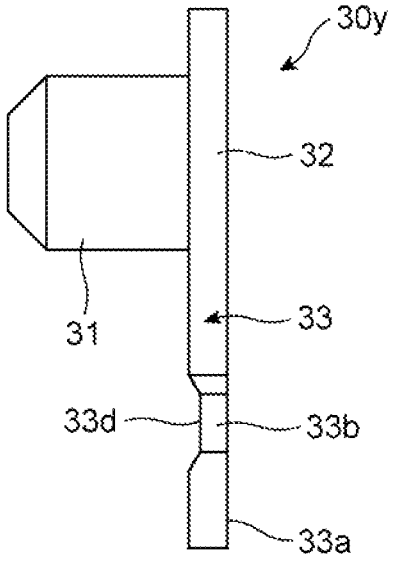
FIG. 12C is a right side view of the central terminal illustrated in FIG. 12A.
Figure 12D:
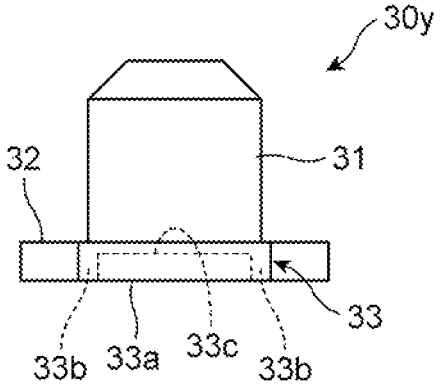
FIG. 12D is a front view of the central terminal illustrated in FIG. 12A.

As illustrated in FIGS. 5, 6 and 8, the second contact 33 is formed with cut-outs 33*b* at an area in which the second contact 33 overlaps or faces the outer terminal 40. The cut-outs 33*b* provide a performance of adjusting an impedance between the central terminal 30 and the outer terminal 40.

The cut-outs 33*b* are formed at opposite sides of the second contact 33. The cut-out 33*b* may be formed at one of sides of the second contact 33.

The outer terminal 40 includes an annular terminal 41 to make mechanical and electrical contact with to plug connector, and an outer contact 42 obliquely and downwardly extending from the annular terminal 41 towards a printed circuit board (not illustrated).

Figure 7:
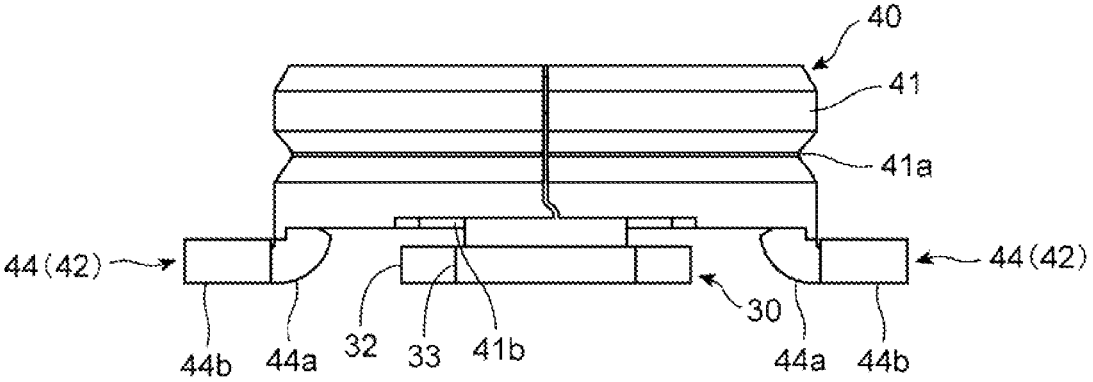
FIG. 7 is a front view of the central terminal and the outer terminal illustrated in FIG. 5.

The annular terminal 41 is coaxial with the first contact 31. The annular terminal 41 is cylindrical and open at opposite ends. As illustrated in FIG. 7, the annular terminal 41 is formed at an outer surface thereof with a V-shaped groove 41*a*. As illustrated in FIGS. 5 and 7, the annular terminal 41 is formed with a rectangular recess 41*b* at an area where the annular terminal 41 faces the second contact 33. When the receptacle connector 10 and the plug connector are fit into each other, the annular terminal 41 makes mechanical and electrical contact at an inner surface thereof with an inner surface of a ring-shaped terminal of the plug connector to be connected to an external conductor of the coaxial cable.

The outer contact 42 includes a first contact portion 43 extending from the annular terminal 41 in a direction opposite to the direction in which the second contact 33 extends, and a pair of second contact portions 44 extending from a bottom of the annular terminal 41 and located facing each other.

Each of the first and second contact portions 43 and 44 includes a leg 43*a*, 44*a* obliquely and downwardly extending towards a printed circuit board (not illustrated), and a contact 43*b*, 44*b* making mechanical and electrical contact with a metal pad mounted on a printed circuit board. The contact 43*b* has a with equal to the same of the leg 43*a*. The contact 44*b* has a width almost equal to a diameter of the annular terminal 41, as illustrated in FIG. 6, and hence, is greater in width than the leg 44*a*.

The cut-outs 33*b* of the second contact 33 are explained in detail hereinbelow.

The second contact 33 extends below and beyond the annular terminal 41, of the outer terminal 40 from the first contact 21, and is exposed externally of the annular terminal 41. Since the first contact 31 passes below the annular terminal 41, there is formed an area in which the first contact 33 and the annular terminal 41 face each other. A capacitance defined in the area exerts harmful influence on the impedance adjustment between the receptacle connector 10 and a coaxial cable connected to a plug connector.

In the receptacle connector 10 in accordance with the first embodiment, the second contact. 33 is formed with the cut-outs 33*b* at an area in which the second contact 33 faces the annular terminal 41 of the outer terminal 40. The cut-outs 33*b* formed at the second contact 33 reduce an area in which the second contact 33 faces the annular terminal 41 of the outer terminal 40, and thus, a capacitance defined with the area can be reduced.

Accordingly, it is possible to adjust the impedance between the outer terminal 40 and the central terminal 30 by controlling a width and/or a length of the cut-outs 33*b*, and hence, the impedance adjustment between the receptacle connector 10 and a coaxial cable connected to a plug connector can be preferably accomplished.

Furthermore, since the cut-outs 33*b* are formed only in an area in which the second contact 33 faces the annular terminal 41, the cutouts 33*b* exert almost no or merely a slight influence on parameters defining an impedance between the second contact 33 and the annular terminal 41. When a receptacle connector not including the cut-outs 33*b* is designed to be low in height, and hence, down-sized entirely, the first contact 33 and the annular terminal 41 cannot avoid from being situated in the vicinity of each other, resulting in that a capacitance defined with an area in which the first contact 33 and the annular terminal 41 face each other unavoidably increases. However, by designing the second contact 33 to have the cut-outs 33*b*, it is possible to prevent the capacitance from increasing. Accordingly, even if the receptacle connector 10 is designed to be down-sized or low in height to thereby cause the first contact 33 and the annular terminal 41 of the outer terminal 40 to be located close to each other, the impedance adjustment between the first contact 33 and the annular terminal 41 can be preferably accomplished by means of the cut-outs 33*b*. Thus, the receptacle connector 10 is capable of readily accomplishing the above-mentioned impedance adjustment, and further, being down-sized.

Since the cut-outs 33*b* are formed at the opposite sides of the second contact 33, even if the second contact 33 had a small width, the cut-out or cut-outs 33*b* can be surely formed at the second contact 33.

Since the annular terminal 41 is formed with the recess 41*b* at an area in which the annular terminal 41 faces the second contact 33, a gap between the annular terminal 41 and the second contact 33 can be sufficiently lengthy, even if the annular terminal 41 is designed to be low in height, and hence, the annular terminal 41 and the second contact 33 are unavoidably located close to each other.

In the receptacle connector 10 in accordance with the first embodiment, the annular terminal 41 is located entirely around the first projection 31. In the receptacle connector 1000 illustrated in FIGS. 13A and 13B, the external terminal 1002 may be partially formed around the central terminal 1001, in contrast, since the annular terminal 41 is designed to be annular to thereby entirely surround the first projection 31, the annular terminal 41 can make contact with a plug connector in a greater area than the receptacle connector 1000. Furthermore, since the central terminal 30 and the outer terminal 40 are arranged coaxial with each other, electric relation between the central terminal 30 and the outer terminal 40 can be enhanced, and reliability to electrical connection between the receptacle connector 10 and a plug connector can be enhanced. Since the second contact 33 is designed to be formed with the cut-outs 33*b* in area in which the second contact 33 overlaps the annular terminal 41, even if the second contact 33 extends in any direction relative to the annular terminal 41, a capacitance defined by the above-mentioned area can be reduced.

Second Embodiment

FIGS. 9 and 10A to 10D illustrate the receptacle connector in accordance with the second embodiment. The receptacle connector in accordance with the second embodiment has the same structure as that of the receptacle connector 10 in accordance with the first embodiment except including a central terminal 30*x* in place of the central terminal 30. Accordingly, parts or elements that correspond to those of the receptacle connector 10 illustrated in FIGS. 1 to 8 have been provided with the same reference numerals, and operate in the same manner as corresponding parts or elements in the first embodiment, unless explicitly explained hereinbelow.

The second contact 33 of the central terminal 30*x* in the second embodiment, illustrated in FIGS. 9 and 10A to 10D, is formed with an opening 330 in an area in which the second contact 33 overlaps the annular terminal 41 of the outer terminal 40. Similarly to the cut-outs 33*b* in the first embodiment, the opening 33*c* formed at the second contact 33 reduces an area in which the second contact 33 faces the annular terminal 41 of the outer terminal 40. Thus, the opening 33*c* reduces a capacitance caused by the above-mentioned area.

Furthermore, even if a shearing force acts on the second contact 33 in a widthwise direction across the opposite ends located in a length-wise direction, it is possible to avoid reduction in a strength in comparison with the second contact 33 formed with the cut-outs 33*b*, because the opening 33*c* reduces an area in which the second contact 33 overlaps the annular terminal 41.

The second contact 33 may be designed to be formed with both the opening 33*c* and the cut-outs 33*b*.

Third Embodiment

FIGS. 11 and 12A to 12D illustrate the receptacle connector in accordance with the third embodiment. The receptacle connector in accordance with the third embodiment has the same structure as that of the receptacle connector 10 in accordance with the first embodiment except including a central terminal 30*y* in place of the central terminal 30. Accordingly, parts or elements that correspond to those of the receptacle connector 10 illustrated in FIGS. 1 to 8 have been provided with the same reference numerals, and operate in the same manner as corresponding parts or elements in the first embodiment, unless explicitly explained hereinbelow.

The second contact 33 of the central terminal 30*y* in the third embodiment, illustrated in FIGS. 11 and 12A to 12D, is formed with the cut-outs 33*b* and further with a recessed portion 33*d* in an area in which the second contact 33 overlaps the annular terminal 41 of the outer terminal 40. The recessed portion 33*d* is formed by reducing a thickness at upper and lower surfaces of the second contact 33.

Since the second contact 33 is formed with the recessed portion 33*d* as well as the cut-outs 33*b*, it is possible to reduce an area in which the second contact 33 faces the annular terminal 41, and to make a gap between the annular terminal 41 and the second contact 33 sufficiently lengthy, even if the annular terminal 41 is designed to be low in height, and hence, the annular terminal 41 and the second contact 33 are unavoidably located close to each other. Thus, the receptacle connector can be designed to be further down-sized or low in height to such a degree as an increase in the gap caused by the recessed portion 33*d*.

The recessed portion 33*d* is formed by reducing a thickness at upper and lower surfaces of the second contact 33 in the third embodiment. It should be noted that the recessed portion 33*d* may be formed by reducing a thickness at one of upper or lower surfaces of the second contact 33.

The receptacle connector in accordance with the third embodiment is designed to include both the cut-outs 33*b* and the recessed portion 33*d*. As an alternative, the receptacle connector may be designed to include both the openings 33*c* (see FIGS. 10A to 10D) and the recessed portion 33*d* or all of the cut-outs 33*b*, the opening 33*c* and the recessed portion 33*d*.

INDUSTRIAL APPLICABILITY

The receptacle connector in accordance with the present invention can be used in an electric connector to be employed in fields such as an electric/electronic device industry and an automobile industry, as a part to be fit into a plug connector to mechanically and electrically connect with the plug connector.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-233291 filed on Nov. 11, 2013 including specification, claims, drawings and summary is incorporated herein by reference in its entirety.

What is claimed is:

1. A receptacle connector, for use with a coaxial cable having a core wire and an external conductor, said receptacle connector comprising:

a central terminal to be mechanically and electrically connected with the core wire of the coaxial cable; and an outer terminal to be mechanically and electrically connected with the external conductor of the coaxial cable, said central terminal including:

a first contact configured to make contact with the core wire; and a second contact electrically connected to said first contact, passing through under said outer terminal and extending to the outside of said outer terminal, said second contact having at least one of a cut-out or an opening in a portion of said second contact where said second contact overlaps said outer terminal, said cut-out being formed at at least one of side edges of said second contact, and said opening being formed through said second contact in a thickness-wise direction.

2. The receptacle connector as set forth in claim 1, wherein said portion of said second contact having the at least one of the cut-out or the opening is thinner than other portions of said second contact.

3. The receptacle connector as set forth in claim 2, wherein said second contact has an upper surface and a lower surface, and the second contact includes a recess formed on at least one of the upper and lower surfaces of the second contact.

4. The receptacle connector as set forth in claim 1, wherein said outer terminal includes a recess in a portion of said outer terminal that faces said second contact.

5. The receptacle connector as set forth in claim 1, wherein said outer terminal is ring-shaped coaxially with said central terminal.

6. A terminal electrically for use with a coaxial cable including a core wire, and an external conductor surrounding the core wire with an internal electrical-insulator being sandwiched therebetween, the terminal to be mechanically and electrically connected to the core wire, and being used together with a second terminal mechanically and electrically connected to the external conductor, said terminal comprising:

a first contact configured to make contact with the core wire; and a second contact being in the form of a plate, said second contact having a length sufficient to pass through under said second terminal and extend to the outside of the second terminal when said terminal is used together with the second terminal, said second contact having at least one of a cut-out or an opening in a portion of said second contact where said second contact overlaps the second terminal, said cut-out being formed at at least one of side edges of said second contact, and said opening being formed through said second contact in a thickness-wise direction.

7. The terminal as set forth in claim 6, wherein said portion of said second contact having the at least one of the cut-out or the opening is thinner than the portions of said second contact.

8. The terminal as set forth in claim 7, wherein said second contact has an upper surface and a lower surface, and the second contact includes a recess formed on at least one of the upper and lower surfaces of the second contact.

* * * * *